US005697426A

United States Patent [19]

Matuszczak et al.

[11] Patent Number: 5,697,426

[45] Date of Patent: Dec. 16, 1997

[54] RACK FOR HOLDING A SET OF TUBES, IN PARTICULAR FOR FORMING A HEAT EXCHANGER

[75] Inventors: Richard Matuszczak, Henin; Francis Noppe, Villeneuve D'Ascq, both of France

[73] Assignee: GEC Alsthom Stein Industrie, Velizy Villacoublay, France

[21] Appl. No.: 663,366

[22] Filed: Jun. 13, 1996

[30] Foreign Application Priority Data

Jun. 15, 1995 [FR] France ..... 95 07149

[51] Int. Cl.[6] ..... F28F 9/00

[52] U.S. Cl. ..... 165/67; 165/162; 165/DIG. 424

[58] Field of Search ..... 165/67, 162, DIG. 424, 165/DIG. 425, DIG. 426; 122/510

[56] References Cited

U.S. PATENT DOCUMENTS

| | | | |
|---|---|---|---|
| 3,929,189 | 12/1975 | Lecon | 165/69 |
| 3,998,268 | 12/1976 | Sagan | 165/162 |
| 4,325,171 | 4/1982 | Nobles | 165/159 X |
| 4,359,088 | 11/1982 | Jabsen | 165/172 |
| 4,570,883 | 2/1986 | Wepfer | 248/49 |

FOREIGN PATENT DOCUMENTS

| | | | |
|---|---|---|---|
| 2026116 | 9/1970 | France . | |
| 1126804 | 11/1984 | U.S.S.R. | 165/162 |
| 1355653 | 6/1974 | United Kingdom | 165/162 |
| 2024399 | 1/1980 | United Kingdom | 165/162 |

*Primary Examiner*—Allen J. Flanigan

*Attorney, Agent, or Firm*—Sughrue, Mion, Zinn, Macpeak & Seas, PLLC

[57] ABSTRACT

The present invention relates to a rack for holding a set of tubes, in particular for forming a heat exchanger, each of the tubes making up the set being provided with a helical outer fin, and said tubes being disposed in n rows of p tubes, the rack including transverse holding section members disposed between each row and longitudinal holding lugs engaged in gaps between the turns of the fins on the corresponding tubes. Bars that are perpendicular to said transverse holding section members separate the p adjacent tubes in each of the n rows, the transverse holding section members being threaded through n-1 orifices provided in the bars, said bars and said section members forming a holding mesh. The longitudinal holding lugs are constituted by separate brackets, each of which includes an engageable lug and at least one fastening tab for fastening it to said mesh.

5 Claims, 3 Drawing Sheets

RACK FOR HOLDING A SET OF TUBES, IN PARTICULAR FOR FORMING A HEAT EXCHANGER

The present invention relates to a rack for holding a set of tubes, in particular for forming a heat exchanger.

BACKGROUND OF THE INVENTION

The present invention relates more precisely to a rack for holding a set of tubes, each of the tubes making up the set being provided with a helical outer fin, and said tubes being disposed in n rows of p tubes, the rows being delimited by support section members, the rack including transverse holding section members disposed between each row and longitudinal holding lugs secured to said transverse holding section members and engaged in gaps between the turns of the fins on the corresponding tubes.

Between each row of tubes, such a known rack includes a certain number of transverse holding square section members of side h. One face of each transverse square section member is welded to perpendicular section members of side h, of length substantially equal to the sum of the diameters of the tubes, and spaced apart from one another at a distance substantially equal to the diameter of the tubes. The opposite face of each of the transverse square section members is welded to holding lugs, each of which is disposed between two preceding section members, the lugs being spaced apart at a distance chosen as a function of the required longitudinal holding strength.

A plurality of transverse holding section members constituted in this way are distributed along the length of the set. The tubes are received between the perpendicular section members. Another series of transverse holding members are disposed on the tubes, their lugs being engaged in gaps between the turns of the fins on the tubes. The perpendicular section members on the first transverse holding section members are then welded to the second transverse holding section members. The first row is then fixed and the following rows are held in the same way by installing and welding analogous section members.

Such a set of tubes generally constitutes a heat exchanger designed to pass a heat-conveying fluid, and it is designed to be installed vertically or horizontally in a heat-recovering boiler, e.g. at the output of a gas turbine.

By engaging the longitudinal holding lugs onto the tubes, the resulting holding mesh can move with the tubes as they expand longitudinally.

Making such a known holding rack requires the following steps to be taken:

- transverse holding section members provided with their perpendicular section members and with their holding lugs must be prefabricated with acceptable tolerances for the distances between the various elements;
- a certain number of integral lugs must be engaged in gaps between the turns of the fins at the same time as the transverse holding section member is being installed;
- each perpendicular section member in a first series of transverse holding section members must be welded to a second series of transverse holding section members.

OBJECTS AND SUMMARY OF THE INVENTION

The invention makes all of these steps unnecessary since no equivalent prefabrication or equivalent welding is required, while also facilitating installation of the various elements of the holding rack. A rack can thus be obtained that is less costly both in terms of material and in terms of labor.

To this end, according to the invention:

bars that are perpendicular to said transverse holding section members and that are secured via their ends to the support section members separate the p adjacent tubes in each of the n rows, the transverse holding section members being threaded through n-1 orifices provided in the bars, said bars and said section members forming a holding mesh; and the longitudinal holding lugs are constituted by separate brackets, each of which includes an engageable lug and at least one fastening tab for fastening it to said mesh.

The separate brackets can be installed much more easily than the prior art integral lugs given the random nature of the positioning of the fins on the tubes, and given that deformation might be necessary in order to engage the lugs in gaps between the turns of the fins.

In a preferred embodiment, the fastening tab is fixed to the corresponding transverse holding section member by being deformed around said section member.

Advantageously, said bars are constituted by flat bars.

Preferably, said brackets are U-shaped, the web of the U constituting the engageable lug, and the branches of the U forming two fastening tabs.

The invention also provides a heat exchanger constituted by a set of tubes disposed in n rows of p tubes, a plurality of holding racks as described above holding the set, the racks being distributed over the length of said set.

BRIEF DESCRIPTION OF THE DRAWINGS

A preferred embodiment of the invention is described in more detail below with reference to the accompanying drawings, in which.

MORE DETAILED DESCRIPTION

Figure 1:
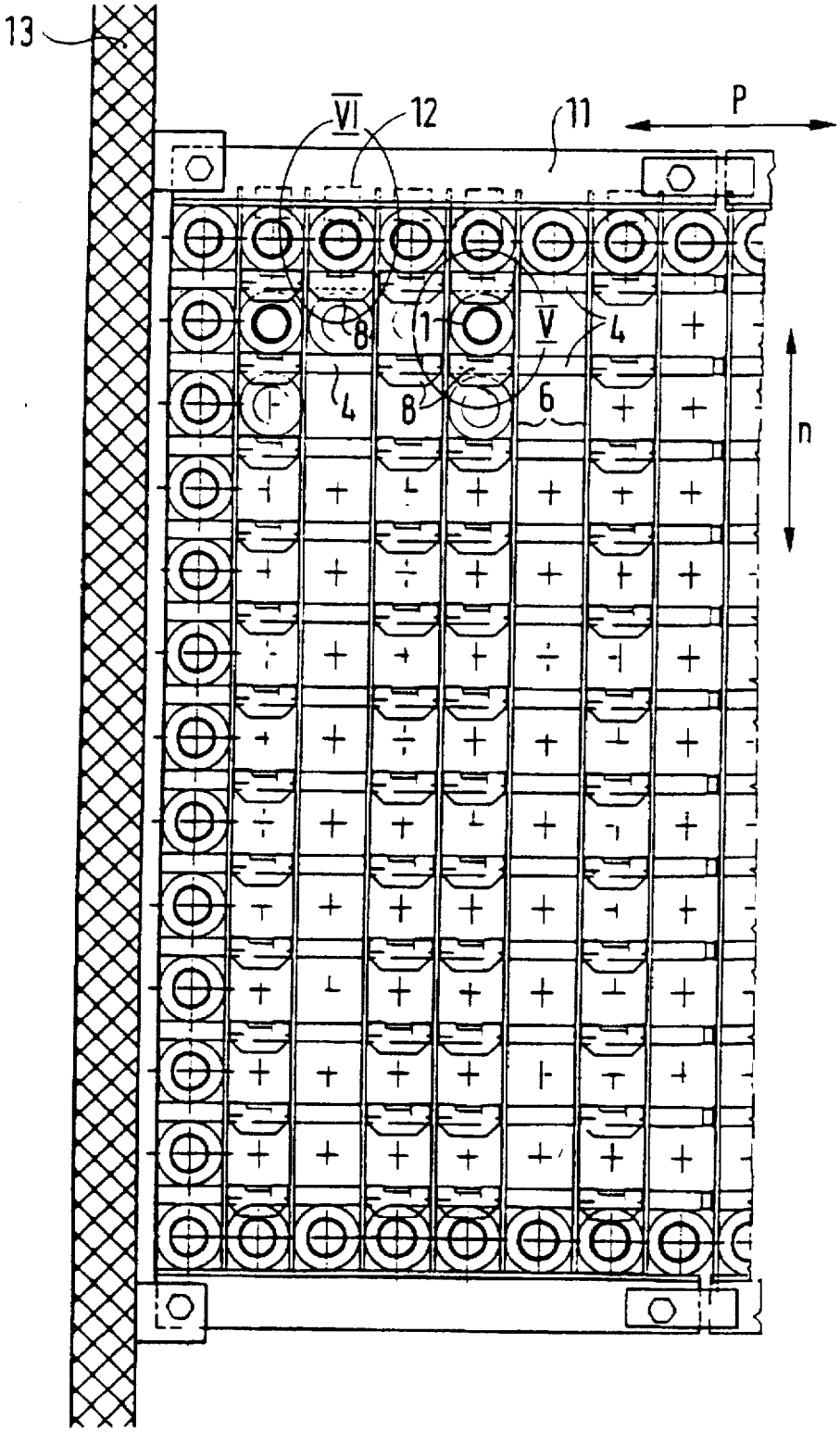
FIG. 1 is a fragmentary plan view of a set of tubes provided with a holding rack of the invention.
Figure 2:
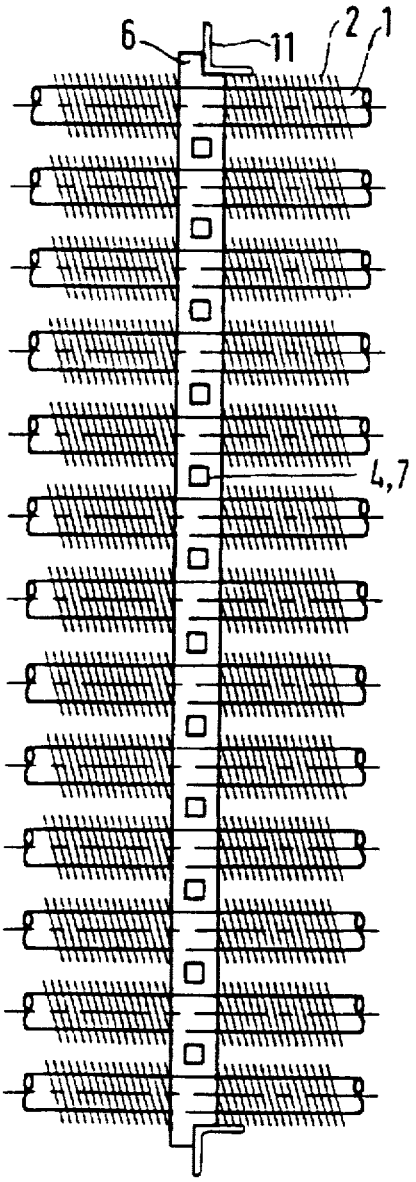
FIG. 2 is a section view on II—II of FIG. 1.

FIGS. 1 and 2 are fragmentary views showing a heat exchanger that is preferably vertical and that is supported at the top of the heat-recovering boiler in which it is installed. Over the height of the boiler, the heat exchanger must be held by racks of the invention distributed over said height.

The heat exchanger is constituted by a set of tubes 1 which are preferably of the same diameter, each of the tubes making up the set being provided with a helical outer radial fin 2, and the tubes being disposed in n rows 3 of p tubes 1. Along its sides, the set is connected to support section members constituted by angle bars 11 which are secured by means of screws or the like to the refractory wall 13 delimiting the boiler.

The holding rack comprises:

- transverse holding section members 4 (preferably of square section), a respective transverse holding section member being disposed between each row 3;
- bars 6 that are advantageously flat, that are perpendicular to said transverse holding section members 4, and that separate the p adjacent tubes 1 in each of the n rows 3, the transverse holding section members 4 being threaded through n-1 orifices 7 (preferably punched out) spaced apart substantially by the diameter of the tubes and provided in the bars 6, said bars 6 and said section members 4 forming a holding mesh; and separate brackets 8, each of which includes an engageable lug 9 forming a longitudinal holding lug engaged in a gap between the turns of the fin 2 of the corresponding tube 1 and at least one fastening tab 10 for fastening it to said mesh, which tab is fixed to the corresponding transverse holding section member 4 by being deformed around said section member 4.

Figure 3:
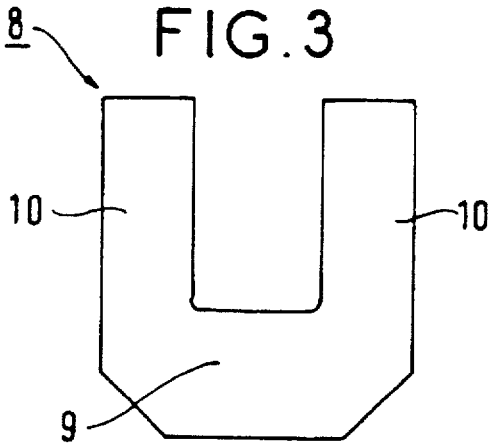
FIG. 3 is a plan view of a longitudinal holding bracket used in the rack of the invention, prior to the bracket being folded.
Figure 4:
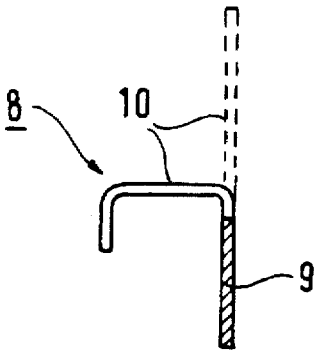
FIG. 4 is a side view of the bracket in the folded state.

A bracket 8 is shown in the non-folded state in FIG. 3 and in the folded state in FIG. 4.

It is U-shaped, the web of the U constituting the engageable lug 9 and the branches of the U forming two fastening tabs 10.

Figure 5:
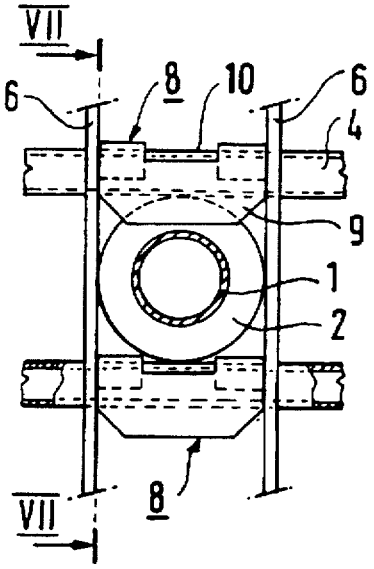
FIG. 5 is a view of the detail V of FIG. 1.
Figure 7:
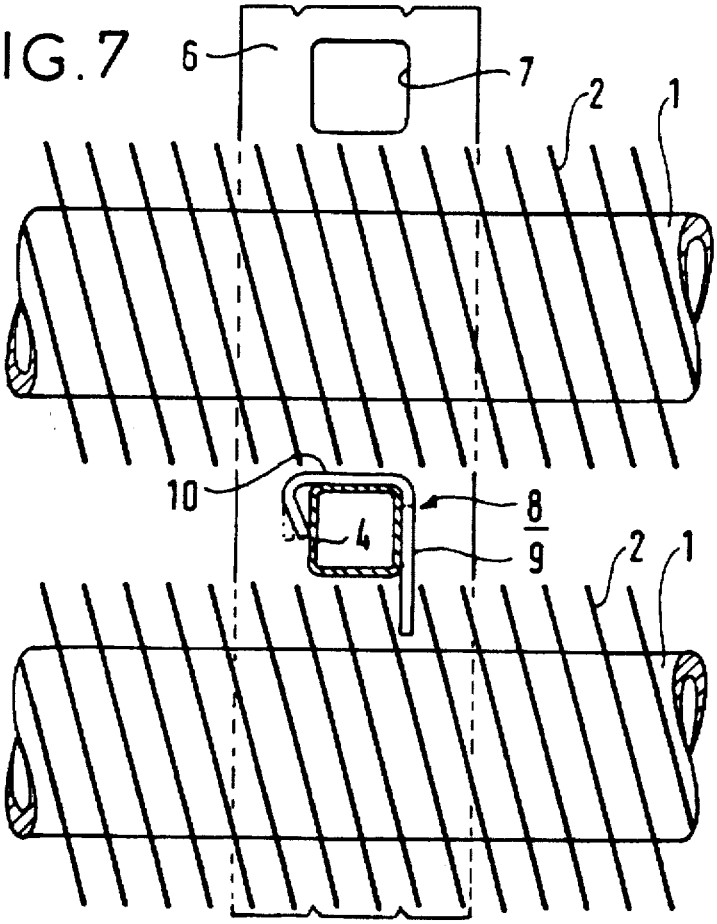
FIG. 7 is a section view on VII—VII of FIG. 5.

Both branches 10 are folded twice at right angles so as to clamp a transverse holding section member as shown in FIGS. 5 and 7.

Once the tubes 1 in one row 3 have been put in position, each of the brackets 8 is engaged via its engageable lug 9 into a gap between the turns of the fin 2 on a tube that has already been put in position, and its tab 10 as folded clamps the section member 4 to which it is secured by punching.

Figure 6:
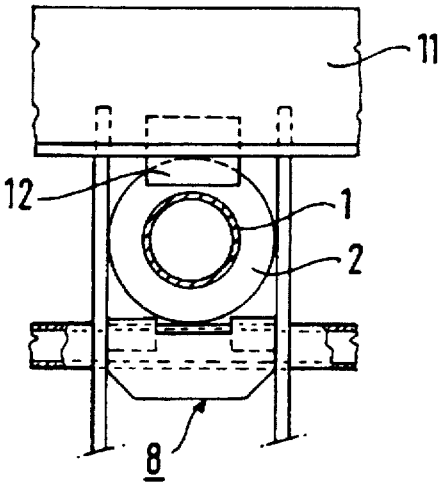
FIG. 6 is a view of the detail VI of FIG. 1.

FIG. 6 is a detail view of a tube 1 disposed at the side edge of the set where it is held by the angle bar 11 to which the flat bars 6 are welded, as are plates 12 which are engaged in gaps between the turns of the fins of the corresponding tubes 1.

Such a set is assembled with the tubes 1 positioned horizontally and as follows, at various points distributed over the length of the set:

the first angle bar 11 is welded to one end of each of the flat bars 6, with a tube 1 being placed between each flat bar;

transverse holding section member 4 is threaded through the first orifice 7 so as to lock the first row of tubes 1 transversely;

a certain number of brackets 8 are installed as described above, said number being chosen as a function of the required longitudinal holding strength; and a second row of tubes 1 is placed on the section member 4, and the preceding steps are reproduced until the last row, where the second angle bar 11 equipped with plates 12 is welded to the other end of each of the flat bars 6.

We claim:

1. A rack for holding a set of tubes, each of the tubes making up the set being provided with a helical outer fin, and said tubes being disposed in a rows of p tubes, the rows being delimited by support section members, the rack including transverse holding section members disposed between each row and longitudinal holding lugs secured to said transverse holding section members and engaged in gaps between the turns of the fins on the corresponding tubes, wherein:

bars that are perpendicular to said transverse holding section members and that are secured via their ends to the support section members separate the p adjacent tubes in each of the n rows, the transverse holding section members being threaded through n−1 orifices provided in the bars, said bars and said section members forming a holding mesh; and the longitudinal holding lugs are constituted by separate brackets, each of which includes an engageable lug and at least one fastening tab for fastening it to said mesh.

2. A rack according to claim 1, wherein the fastening tab is fixed to the corresponding transverse holding section member by being deformed around said section member.

3. A rack according to claim 1, wherein said bars are constituted by flat bars.

4. A rack according to claim 1, wherein said brackets are U-shaped, the web of the U constituting the engageable lug, and the branches of the U forming two fastening tabs.

5. A heat exchanger constituted by a set of tubes disposed in n rows of p tubes, wherein a plurality of holding racks according to claim 1 hold the set, the racks being distributed over the length of said set.

* * * * *